United States Patent [19]

Royer et al.

[11] 4,345,952

[45] Aug. 24, 1982

[54] METHOD FOR THE MANUFACTURE OF TUBES FROM STEEL HAVING HIGH DUCTILITY AT LOW TEMPERATURE

[75] Inventors: Alain L. A. Royer, Vandoeuvre les Nancy; Eugene Herzog, Nantes; Robert M. L. Rouyer, Fumel, all of France

[73] Assignee: Pont-A-Mousson S.A., Nancy, France

[21] Appl. No.: 212,166

[22] Filed: Dec. 2, 1980

Related U.S. Application Data

[63] Continuation of Ser. No. 47,964, Jun. 12, 1979, abandoned.

[30] Foreign Application Priority Data

Jun. 12, 1978 [FR] France ..... 78 17864

[51] Int. Cl.[3] ..... C21D 9/08

[52] U.S. Cl. ..... 148/3; 148/36

[58] Field of Search ..... 148/2, 3, 12 F, 12.3, 148/12.4, 36, 134, 142, 143, 153; 164/421, 422, 286; 75/123 N, 123 J

[56] References Cited

U.S. PATENT DOCUMENTS

| | | | |
|---|---|---|---|
| 3,954,133 | 5/1976 | Miyaoka | 148/3 |
| 3,960,612 | 6/1976 | Kaku et al. | 148/36 |
| 4,030,944 | 6/1977 | Sommer et al. | 148/2 |
| 4,043,807 | 8/1977 | Kirman | 75/123 N |

FOREIGN PATENT DOCUMENTS

| | | | |
|---|---|---|---|
| 45-41500 | 12/1970 | Japan | 75/123 J |
| 54-12891 | 5/1979 | Japan | 148/3 |
| 1191317 | 5/1970 | United Kingdom | 75/123 J |

OTHER PUBLICATIONS

Listhuber et al, "High-Strength Pipe Steels", *Metal Science & Heat Treatment,* Sep.-Oct. 1975, vol. 17, pp. 1012-1017.

"High Strength Steels Reach a New Plateau of Quality", *Iron Age,* Feb. 10, 1975, pp. 48 and 49.

Moxley, "Centrifugal Casting of Steel", *Transactions of the ASME,* Oct. 1944, pp. 607-614.

*Primary Examiner*—Peter K. Skiff

*Attorney, Agent, or Firm*—Sughrue, Mion, Zinn, Macpeak & Seas

[57] ABSTRACT

Tubes and method of manufacturing tubes from alloyed steel adapted to be welded for underwater hydrocarbon pipelines having high ductility at low temperatures. A low carbon alloyed steel containing less than 0.08% carbon and with at the most 0.30% silicon, also containing manganese and a metal generating special carbides such as molybdenum, niobium, vanadium and like-acting substances, is cast in a centrifugal casting mould after which the centrifugally cast tube is subjected to controlled cooling and a thermal treatment. Tubes so constructed may be used for drilling tubes, tubes for underwater pipelines and tubes for the construction of drilling platforms at sea in cold regions and applications requiring high ductility at low temperature.

13 Claims, 4 Drawing Figures

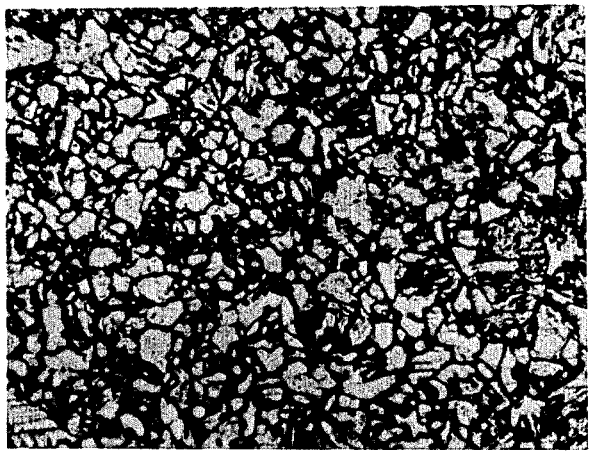
Fig. 4
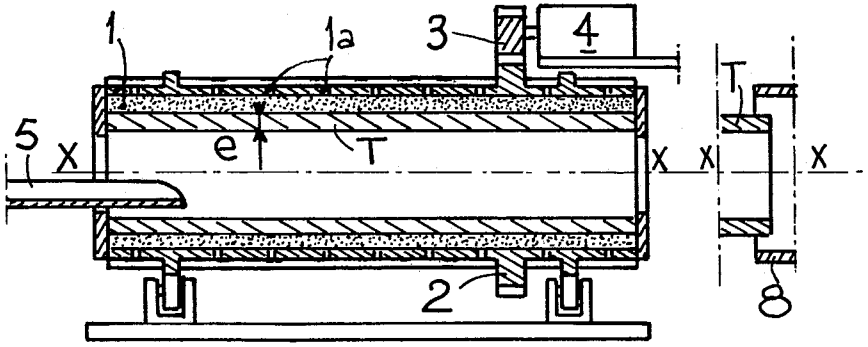
Fig. 1
Fig. 3
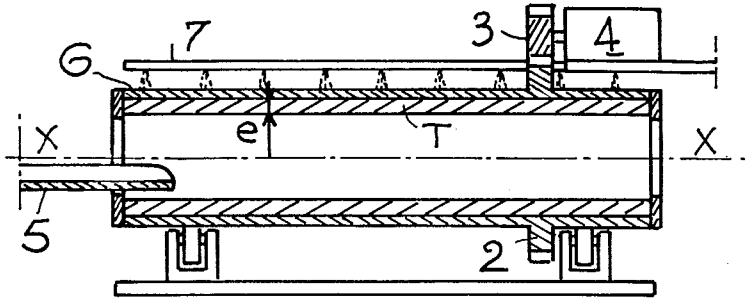
Fig. 2

METHOD FOR THE MANUFACTURE OF TUBES FROM STEEL HAVING HIGH DUCTILITY AT LOW TEMPERATURE

This is a continuation, of application Ser. No. 47,964, filed June 12, 1979 (now abandoned).

BACKGROUND OF THE INVENTION

The present invention relates to tubes and the manufacture of tubes from alloyed steel, which tubes can be welded in order to form underwater pipelines for hydrocarbons, tubes for oil drilling and the construction of drilling platforms at sea which provide a particularly high degree of safety and for applications requiring good ductility at low temperatures and in particular low sensitivity to the grooving effect at low temperatures.

More particularly, the invention relates to exploitation of hydrocarbon deposits in arctic regions and to the manufacture of tubes of great thickness for use therein.

A known method for the manufacture of tubes of this type includes of choosing favourable compositions of steel alloyed with manganese and molybdenum, of forming sheets from the latter and of subjecting the sheets to controlled rolling.

Unfortunately, with the known method, the maximum thicknesses are limited to 30 mm and the method has a number of metallurgical drawbacks.

For example, in a tube produced by this method the isotropy of the tube decreases with thickness with the ratio of transverse resilience to longitudinal resilience being of the order of 0.6 to 0.7 with sheets having a thickness of 30 mm. This means that its transverse resilience is much less than the longitudinal resilience.

The applicant has discovered that if, instead of working the structure of the steel by rolling, the steel is shaped by centrifugal moulding and if the centrifuged product is subjected to controlled cooling and a suitable thermal treatment, one obtains a ferritic structure with very fine grains with a tube thickness substantially greater than 30 mm, even up to 150 mm, while one obtains mechanical characteristics which are high and identical in all directions, that is, isotropic. Furthermore, one obtains a centrifuged product which is quite suitable for welding.

This discovery is all the more surprising as moulded products hitherto were considered as being of inferior quality to rolled products and had more structural irregularities whereas it was thought that working or rolling breaks the casting texture and making it possible to obtain optimum characteristics at least in the direction of rolling.

SUMMARY OF THE INVENTION

The invention therefore relates to a method for the manufacture of a tube from a low carbon alloyed steel which can be welded, including the steps of providing a steel having in addition to iron, at the most 0.08% by weight carbon, at the most 0.30% by weight silicon, and 1.20 to 2.20% by weight manganese and containing metal-generating special carbides, pouring a steel of this type into a tubular centrifugation mould to form a tube and subjecting the centrifuged tube to a thermal treatment the precise nature of which depends on the thickness of the centrifuged tube but which comprises at least controlled cooling, hardening and annealing.

The invention also relates to a tube of low carbon alloyed steel which can be welded which is obtained by the above method of which its composition includes at the most 0.08% by weight carbon, at the most 0.30% by weight silicon, manganese between 1.20 and 2.20% by weight and metal-generating special carbides and having a homogeneous ferritic structure with very fine grains with special carbides dispersed homogeneously in the ferrite.

Steel tubes are thereby produced having a diameter of between 100 and 2000 mm and a thickness of between 10 and 150 mm.

Further features and advantages will become apparent from the description which follows.

BRIEF DESCRIPTION OF THE DRAWINGS

In the accompanying drawings, given solely by way of example,

FIG. 1 is a diagrammatic sectional view of an apparatus for the centrifugal casting of a tube in a sand mould in accordance with the invention;

FIG. 2 is a similar view of an apparatus for the centrifugal casting of a tube in a permanent mould;

FIG. 3 is a partial diagrammatic view showing the end of a centrifuged tube introduced into the entrance of a thermal treatment furnace;

FIG. 4 is a micrograph with a magnification of 400, showing a sample, after nital etch, having a ferritic structure of a centrifuged steel with very fine grains belonging to a tube according to the invention.

DESCRIPTION OF THE PREFERRED EMBODIMENTS

According to a preferred embodiment described herein, the invention relates to weldable tubular constructions commonly referred to by the term "off-shore constructions" which means that these constructions are at sea, off the coast, or as underwater oil pipelines in arctic regions. The invention also more generally relates to products intended to be used at low temperature.

The invention includes providing low carbon weldable alloyed steels of a known type containing at the maximum 0.08% carbon and containing manganese as well as metal-generating special carbides such as molybdenum, niobium, vanadium or tantalum, shaping these steels according to a disclosed method of centrifugal casting for forming tubes, controlling the cooling of such tubes and subjecting them to a suitable thermal treatment.

More particularly, a high strength steel is employed having the following composition with percentage by weight of the total, in addition to iron, of:

carbon $\leqq$ 0.08%
silicon $\leqq$ 0.30%
manganese from 1.20 to 2.20%
molybdenum from 0.20 to 0.50%
sulphur $\leqq$ 0.010%
phosphorus $\leqq$ 0.015%.

Until recent years, increasing the carbon content of carrying out controlled rolling were the simplest means of raising the elastic limit. However, both had a number of significant drawbacks.

These problems have been overcome with the invention by the use of two hardening techniques which do not destroy the ductility of steel tubes:

rendering the grains of a ferritic structure finer, hardening by precipitation of a "carbide" phase, which is sufficiently stable and dispersed in a homogeneous manner in the ferrite.

The fine ferritic structure and the stable and homogeneously dispersed carbide phase are obtained firstly by utilizing the above contents of carbon, silicon and manganese, the carbon remaining above 0.03% and then by adding special elements such as molybdenum, vanadium, niobium or even tantalum, which promote the formation of a hardening phase by precipitating in the form of fine carbides, nitrides or carbo-nitrides at high temperature thereby limiting the enlargement of the austenitic grain which thus makes the structure finer. Molybdenum, niobium, vanadium, tantalum and other metals of the same family are generators of such special carbides.

Furthermore, for purposes of de-oxidation, small quantities of aluminium of 0.02 to 0.08% and traces of calcium and cerium are provided.

According to the invention, a steel of this type is shaped in a unique manner by casting in a centrifugal casting mould which is suitably aerated or cooled and which is either a sand mould or a permanent mould such as a metal chill mould.

According to the example of FIG. 1, centrifugal casting takes place in the following manner:

a tubular centrifugal casting mould is provided axis X—X including a special sand 1 with air-vents 1*a*. The mould 1 is set in rotation about its axis X—X, for example by a toothed ring 2 and a pinion 3 meshing with the ring 2 and a speed-reducer unit 4.

Liquid steel having the composition described previously is poured into the cavity of the sand mould 1 through a runner 5 while a translatory movement is provided between the mould 1 and the runner 5 in order to enable the latter to pour the liquid metal over the entire length of the mould. To accomplish this, either the mould 1 is supported by a carriage which carries out a translatory movement with respect to the stationary runner 5 or the runner 5 is moved with the mould 1 stationary. In this example, the mould 1 is stationary. Centrifugal casting installations of this type are well-known.

Centrifugal casting in a special sand mould is used specifically for manufacturing one article at a time or for small numbers of articles, since, after each casting operation, it is necessary to use a new sand mould 1, because the sand may only be used for a single casting operation. Sand moulds can also be used for the centrifugal casting of very thick tubes of large diameter.

A steel tube T whose diameter may vary from 100 to 2000 mm according to the inside diameter of the sand mould 1 and whose thickness e may be between 10 and 150 mm is thus cast. The length of tube T cast in this way may vary between 3 and 12 meters according to the diameters and thicknesses.

According to the embodiment of FIG. 2, a permanent centrifugal casting mould is used, namely a chill mould 6, while the rest of the centrifugal casting machine is similar to the preceding example. The chill mould 6 is cooled externally, for example by means of a row 7 of jets spraying water. The internal wall of the chill mould 6 is coated with a known coating which is not shown, serving both to protect the chill mould and to aid in obtaining a sound casting T.

This method is used to cast tubes whose outer diameter varies from 90 to 1000 mm with thickness of from 10 to 120 mm according to the individual case. The length of the tubes T cast in this way varies between 2 and 10 meters according to the diameters and thicknesses.

After centrifugal casting and before thermal treatment, cooling of the tube T is carried out at a controlled cooling rate speed. This cooling takes place before stripping in the case of the sand mould 1 and in a pit, after stripping, in the case of the chill mould 6.

After stripping of a centrifugally cast tube or extraction of the latter either from a sand mould 1 or a chill mould 6, the structure is quite coarse.

The stripped tube T then undergoes a homogenisation treatment up to a temperature of 1,050° C., by placing the latter according to the diagram of FIG. 3 in a suitably regulated thermal treatment furnace 8.

The latter is then subjected to a thermal hardening treatment of a controlled cooling rate speed from an austenitisation temperature of between 800° to 950° C. and a thermal annealing treatment at a temperature of between 600° and 700° C. These treatments make is possible to regulate the levels of the desired mechanical characteristics.

The above-mentioned thermal treatments are those to which tubes having the greatest thickness are subjected such as, for example, a thickness of between 60 and 150 mm.

In fact, the precise nature of the thermal treatments used depends on the thickness of the tube within the range of thicknesses of between 10 and 150 mm. For average and small thicknesses of between 10 and 60 mm, cooling by hardening and annealing.

The cycle of these thermal treatments ensures the desired morphology of the ferrite as well as dispersion of the carbides in the ferrite.

If one takes a sample from a steel tube T, for the purpose of a micrographic examination of its structure (FIG. 4), it will be noted that the structure is constituted by grains of very fine needle-shaped ferrite. The size of the grains obtained is greater than 10 according to the American ASTN scale (Standard E.112–63 relating to the measurement of the size of the grains). The size of the carbides is from 1 to 2 microns and their spacing from 2 to 10 microns. The carbides are very uniformly distributed in the ferrite and are mostly absent from the joints of the ferrite grains.

The structure is thus homogeneous and isotropic.

The combination of the following elements of the invention:

choice of the analysis of the steel,
centrifugal casting,
controlled cooling,
homogenisation, hardening after austenitisation and annealing, makes it possible to obtain steel tubes having very good mechanical characteristics, that is, having an optimum combination of the characteristics of strength and ductility, even at low temperature. In contrast to other known methods, the value of the contraction of cross section of steels for tubes according to the invention is systematically greater than 50%, such that any danger of "laminar tearing", or tearing by cleavage during welding even on very thick tubes is eliminated. In addition, the metallurgical state of such steels is a stable state since it is obtained by thermal treatments, in contrast to the state of steels obtained by thermo-mechanical treatment such as rolling.

The low carbon content, the fineness of the grains of ferrite, and the stability of the structure ensure a product which can be easily welded under conventional operating conditions and without requiring pre-heating, at least up to relatively high thicknesses (60 mm). In addition, due to a proper choice of the material used for welding and of the operating technique used for welding, it is possible to obtain mechanical characteristics substantially identical to those of the base material in areas affected by heat. If the welding operations are carried out at a suitable temperature, the mechanical characteristics of the basic metal are not substantially modified so that the mechanical characteristics of the basic metal and of the area welded are homogeneous.

By way of example, the table of Appendix 1 gives three variations of composition and thermal treatment for steel tubes of the invention and an example of the manufacture of a tube by centrifugal casting.

As will be seen by comparing the variations of steel, variation 11 differs from variation I by the presence of niobium in addition to molybdenum, which gives the steel increased mechanical strength and an increased elastic limit without an appreciable drop in elongation at rupture and without loss of resilience.

Variation III differs from variation I by the presence of vanadium and possibly traces of niobium. This variation has mechanical characteristics which are clearly increased with respect to those of variation I, but slightly reduced values of elongation at rupture and resilience.

These variations contain very low percentages of sulphur and phosphorus.

The manufacturing example given in the table is taken from variation III.

Advantages of the tubes according to the invention (a) Advantages of centrifugal casting The effects of centrifugal force are used to apply the cast metal against the impression of the mould in a uniform manner. The metal is subjected to an acceleration of 80 to 120 g. Owing to this considerable acceleration, the liquid metal is purified. Under the action of the centrifugal force, the heavy constituents are forced to the outside and the light constituents to the inside thereby bringing the dross, gases and impurities which are lighter than the metal to the inside of the cavity. This inner layer of impurities may be removed by machining. Rapid solidification in cooled moulds at a high pressure gives a fine grain, improved mechanical properties and better density. The properties are essentially isotropic, although there may be a small variation in a transverse direction to the axis of rotation in thick castings.

Well-controlled directional solidification prevents the formation of fragile areas.

The structures are extremely fine owing to intense cooling.

After solidification, the thermal cycle of cooling of the centrifugally cast tube may be controlled.

(b) Metallurgical advantages:

The metallurgical advantages of the invention, include:

purity of the metal,
isotropy of the physical and mechanical properties,
absence of fragile areas,
highly adapted for welding.

Concerning weldability in particular, due to the homogeneity of their structure, centrifugally cast steels can be welded without difficulties.

As a variation, according to the thickness of the tube to be manufactured, it is possible to add nickel, which promotes high values of ductility without any loss of strength. The quantity of nickel added may be up to 1.5%.

Finally, for the purpose of de-oxidation, small quantities of aluminium of between 0.02 and 0.08% by weight of the total composition as well as traces of calcium and cerium may be added.

APPENDIX 1

| Chemical composition as a % by weight in addition to iron | | Variation of Steel I | Variation of Steel II | Variation of Steel III | Steel tube cast in a sand mould outer diameter: 320 mm thickness: 60 mm length: 6,250 mm (Variation of steel III) |
|---|---|---|---|---|---|
| Carbon | | ≦0.08 | | | 0.08 |
| Guaranteed equivalent carbon | | ≦0.42 | | | |
| Manganese | | 1.2 to 2.2 | as variation I | as variation I | 2.00 |
| Molybdenum | | 0.20 to 0.50 | | | 0.42 |
| Silicon | | ≦0.30 | | | 0.29 |
| Niobium | | | 0.03 to 0.06 | traces | |
| Vanadium | | | | 0.10 | 0.082 |
| Phosphorus | | ≦0.015 | | | 0.011 |
| Sulphur | | ≦0.010 | | | 0.08 |
| Thermal treatment | | Homogenisation hardening - annealing | as variation I | as variation I | Homogenisation hardening - annealing |
| Mechanical characteristics | | | | | |
| tensile strength daN/mm² | R | 50–64 | 52–66 | 60–70 | 66.7 |
| elastic limit daN/mm² | E | 34–40 | 40–50 | 50–60 | 59.4 |
| elongation at rupture | % | ≧ 20 | ≧18 | ≧16 | 19 |
| contraction of cross-section | % | ≧50 | ≧50 | ≧50 | 61.5 |
| mean KCV in joules at −40° C. (resilience according to French Standard A03-161) | | ≧61 | ≧61 | ≧40 | 148 to 220 |

We claim:

1. A method for manufacturing a tube from low carbon alloyed steel adapted to be welded, comprising the steps of: selecting a steel having at the most, as a percentage by weight, in addition to iron, 0.08% carbon, at the most 0.30% silicon, between 1.20 and 2.20% manganese and at least one metal-generating special carbide such as molybdenum, centrifugally casting a steel having contents of molybdenum from 0.42% to 0.50% and aluminum from 0.02% to 0.08% by weight in a centrifugal casting mould to form a tube, and subjecting the centrifugally cast tube after being extracted from the mould to at least controlled cooling, hardening and annealing to produce a mean KCV coefficient of resilience according to ASTM-E-23-64 at minus 40° C. of 148 to 220 joules.

2. The method according to claim 1, further comprising the step of subjecting the centrifugally cast tubes to homogenisation.

3. The method according to claim 1, wherein average and low thickness tubes are obtained, between 10 and 60 mm.

4. A centrifugally cast and weldable tube of weldable steel comprising: a centrifugally cast low carbon alloyed steel tube, said tube thus cast subjected to at least controlled cooling, hardening and annealing and said low carbon alloyed steel comprising by weight, in addition to iron, at the most 0.08% carbon and at the most 0.30% silicon, manganese between 1.20 and 2.20%, at least one metal-generating special carbide and having a homogeneous ferritic structure having fine grains with stable carbides dispersed in a homogeneous manner in the ferrite, comprising molybdenum from 0.42% to 0.50%, aluminum from 0.02% to 0.08% and, vanadium 0.10% and/or traces of niobium the tube having a mean KCV coefficient of resilience according to ASTM-E-23-64 at minus 40° C. of 148 to 220 joules.

5. A steel tube according to claim 4, characterised in that, in addition to molybdenum, the steel comprises 0.03 to 0.06% niobium.

6. A steel tube according to claim 4, characterised in that, in addition to molybdenum, the steel comprises 0.10% vanadium.

7. A steel tube according to claim 4, characterised by the following composition by weight, in addition to iron:

at least one metal-generating special carbide chosen from the group consisting of molybdenum, niobium, vanadium and other metals of the same family, less than 0.015% phosphorus, and less than 0.010% sulphur.

8. A steel tube according to either of claims 4 and 7, having after thermal homogenisation treatment, hardening and annealing a tensile strength from 50 to 70 daN/mm$^2$, an elastic limit between 34 and 60 daN/mm$^2$, an elongation at rupture greater than or equal to values of between 16 and 20, and a coefficient of contraction of cross-section greater than or equal to 50.

9. A steel tube according to claim 4, wherein the steel comprises no more than 1.5% by weight nickel.

10. A steel tube according to claim 4, further comprising traces of calcium and cerium.

11. A steel tube according to either of claims 4 and 7, wherein the steel comprises 0.08% by weight carbon, 2.00% manganese, 0.42% molybdenum, 0.29% silicon, 0.082% vanadium, 0.011% phosphorus, 0.08% sulphur, the remainder being iron and having a tensile strength of at least 66.7 daN/mm$^2$, an elastic limit of at least 59.4 daN/mm$^2$, an elongation at rupture of at least 19%, a coefficient of contraction of cross-section of at least 61.5%, and a mean KCV coefficient of resilience according to ASTM-E-23-64 at minus 40° C. of 148 to 220 joules.

12. A steel tube according to claim 4, having a diameter between 100 and 2000 mm and a thickness between 10 and 150 mm.

13. A steel tube according to claim 4, having a fine ferritic structure composed of grains of ferrite having a size greater than 10 on the ASTM scale and uniformly distributed carbides whose size does not exceed 2 microns.

* * * * *